US007618922B2

(12) United States Patent
Ogino et al.

(10) Patent No.: US 7,618,922 B2
(45) Date of Patent: Nov. 17, 2009

(54) THERMALLY-SENSITIVE RECORDING MEDIUM

(75) Inventors: Akihito Ogino, Tokyo (JP); Seiki Yoneshige, Tokyo (JP); Junpei Natsui, Tokyo (JP); Jun Makihara, Tokyo (JP); Naoki Negishi, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 11/795,354

(22) PCT Filed: Dec. 6, 2005

(86) PCT No.: PCT/JP2005/022736

§ 371 (c)(1),
(2), (4) Date: Jul. 13, 2007

(87) PCT Pub. No.: WO2006/075467

PCT Pub. Date: Jul. 20, 2006

(65) Prior Publication Data

US 2008/0139385 A1 Jun. 12, 2008

(30) Foreign Application Priority Data

Jan. 13, 2005 (JP) ..... 2005-006782

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS 4,948,775 A * 8/1990 Tsuji et al. ..... 503/207
4,962,079 A 10/1990 Matsumoto et al.
5,691,271 A * 11/1997 Yanagihara et al. ..... 503/204

FOREIGN PATENT DOCUMENTS

| | | |
|---|---|---|
| EP | 1 040 933 | 10/2000 |
| EP | 1 167 061 | 1/2002 |
| EP | 1 195 260 | 4/2002 |
| EP | 1 808 238 | 7/2007 |
| JP | 48-30437 | 4/1973 |
| JP | 48-31958 | 4/1973 |
| JP | 01-196389 | 8/1989 |
| JP | 04-201480 | 7/1992 |
| JP | 07-132676 | 5/1995 |
| JP | 08-230324 | 9/1996 |
| JP | 09-164763 | 6/1997 |
| JP | 2001-232940 | 8/2001 |
| JP | 2001-287459 | 10/2001 |
| JP | 2001-293958 | 10/2001 |
| JP | 2002-059663 | 2/2002 |
| JP | 2006-007642 | 1/2006 |

* cited by examiner

*Primary Examiner*—Bruce H Hess
(74) *Attorney, Agent, or Firm*—Flynn, Thiel, Boutell & Tanis, P.C.

(57) ABSTRACT

A thermally-sensitive recording medium having a protecting layer formed on a thermally-sensitive recording layer containing a colorless or pale-colored electron-donating leuco dye and electron-accepting color-developing agent. The thermally-sensitive recording layer is formed on a substrate, and the protecting layer contains a resin that contains a carboxyl group, epichlorohydrin resin and modified polyamine/amide resin, and the thermally-sensitive recording medium exhibits sufficient resistant against water such as rain or humidity, and further is excellent in printing run-ability (head debris and sticking) and sensitivity.

9 Claims, No Drawings

THERMALLY-SENSITIVE RECORDING MEDIUM

FIELD OF THE INVENTION

The present invention relates to a thermally-sensitive recording medium which has an excellent water-resistance, printing run-ability (head debris, sticking) and sensitivity.

BACKGROUND OF THE INVENTION

In general, a thermally-sensitive recording medium is obtained by coating a coating liquid on a substrate such as paper, synthetic paper, film or plastic, wherein said coating liquid is prepared by grinding and dispersing respectively a colorless or pale-colored electron-donating leuco dye and an electron-accepting color-developing agent such as a phenolic compound into fine particles, then mixing them together, and adding a binder, filler, sensitizer, slipping agent and other additives. The obtained thermally-sensitive recording medium develops color by an instant chemical reaction by heating using a thermal head, a hot stamp, a thermal pen or by heating by laser light and a recorded image can be obtained. A thermally-sensitive recording medium is widely used in a terminal printer of a facsimile or computer, an automatic ticket vending machine or a recorder for a measuring instrument, and along with the diversification of uses, a high-level image stability and stability of blank part are becoming to be required for the thermally-sensitive recording medium.

However, since an electron-donating leuco dye and an electron-accepting color-developing agent contained in a thermally-sensitive recording layer can be easily dissolved in many kinds of solvents, the thermally-sensitive recording medium has a problem that blank part develops color easily when contacted with water ink, oil ink or an adhesive and a problem that, when a chemical such as a plasticizer is adhered to the developed recorded image, the image is discolored. For the purpose of dissolving these problems, a technique of forming a protecting layer which is mainly composed of a pigment and resin on a thermally-sensitive recording layer is disclosed in Patent Document 1 and Patent Document 2.

Further, the use of a thermally-sensitive recording medium is expanding to various kinds of tickets, receipts, labels, use for an auto talking machine of Bank, use for inspection of a gas or electric meter or a note for a betting-ticket for horse racing or cycle racing. Therefore, very severe characteristics, which are not required up to the present, are becoming to be required for a thermally-sensitive recording medium. In these uses, since an outdoor use is becoming more common, characteristics and properties of a protecting layer that can endure more severe atmospheres, such as rain or a very high humidity, direct sunshine or the inside of a car during the summer season, are becoming more necessary compared with conventional use.

As the components that compose a protecting layer, for example, water-soluble polymers such as polyvinyl alcohol or starch are used as main components. For the purpose of providing a water-resistance to these components, the technique of using a crosslinking agent such as glyoxal is disclosed in Patent Document 3 and Patent Document 4, but the effect is not yet sufficient. Especially, in Patent Document 4, carboxy-modified polyvinyl alcohol is used as a binder for a protecting layer, epichlorohydrin and glyoxal are used as a crosslinking agent, and this technique provides a water resistance to the carboxy-modified polyvinyl alcohol by carrying out a crosslinking reaction of epichlorohydrin with the carboxyl group of the carboxy-modified polyvinyl alcohol and by carrying out the crosslinking reacting of glyoxal with hydroxyl groups of the carboxy-modified polyvinyl alcohol. However, since the crosslinking reaction rate is too slow, water-resistance is not accomplished instantly and it is difficult to display a sufficient effect just after the coating and drying process. Accordingly, in a case of using epichlorohydrin as a crosslinking agent, a long heat treatment, that is, curing process, is necessary, and problems of background coloring or workability, namely, the product cannot be obtained immediately after production are caused. Further, the water-resistance under severe conditions is not sufficient because the crosslinked part is easily hydrolyzed.

Further, in Patent Document 5, a technique of providing water-resistance by using a hydrophobic resin emulsion, such as an acrylic emulsion, is disclosed, however, since the heat-resistance property of the acrylic emulsion is not sufficient, printing run-ability such as head debris or sticking is harmed, and there is a problem of workability, that is, a desired coating amount cannot be obtained because the viscosity at a high share is low.

Patent Document 1: JP S48-30437 A publication

Patent Document 2: JP S48-31958 A publication

Patent Document 3: JP H8-230324 A publication

Patent Document 9: JP H9-164763 A publication

Patent Document 5: JP H1-196389 A publication

DISCLOSURE OF THE INVENTION

The object of the present invention is to provide a thermally-sensitive recording medium that has a sufficient water-resistance against water such as rain or humidity when used outdoors and, further, is excellent in printing run-ability (head debris, sticking) and sensitivity.

The inventors of the present invention, continued earnest investigations and found that the object of the present invention mentioned above can be solved by forming a protective layer using a resin containing a carboxylic group as a binder, epichlorohydrin resin and a modified polyamine/amide resin as a crosslinking agent for the thermally-sensitive recording medium, and accomplished the present invention.

That is, the present invention is a thermally-sensitive recording medium having a protective layer on a thermally-sensitive recording layer containing a colorless or pale-colored electron-donating leuco dye and electron-accepting color-developing agent, said thermally-sensitive recording layer is formed on a substrate, and said protecting layer comprises a resin that contains a carboxyl group, epichlorohydrin resin and modified polyamine/amide resin. By said thermally-sensitive recording medium, the object of the present invention can be accomplished.

DESCRIPTION OF THE PREFERRED EMBODIMENT

The reason why the present invention can display excellent water resistance as compared with the conventional arts can be considered as follows.

In a protective layer of the thermally-sensitive recording medium of the present invention, a carboxyl group of the resin containing a carboxyl group and an amine or amide part of an epichlorohydrin resin, which is a crosslinking agent, causes a crosslinking reaction and displays a primary water-resistance. Then, since the hydrophilic part of the modified polyamine/amide resin and crosslinked part which has a hydrophilicity attracts each other, this crosslinked part forms a state that is wrapped by setting the hydrophobic groups of the modified polyamine/amide resin outside, that is, the state characterized in that the hydrophilic crosslinked part is protected by a hydrophobic group from water, thus the secondary water-resistance is displayed. Therefore, a stronger water-resistance than the conventional art can be obtained.

Especially, in a case when the resin which contains a carboxyl group is a carboxy-modified polyvinyl alcohol, reasons why a high water-resistance property can be obtained can be considered as follows. That is, the hydrophilic part of the modified polyamine/amide resin is attracted to a hydroxyl group of the carboxy-modified polyvinyl alcohol and forms a wrapped state that the carboxy-modified polyvinyl alcohol is wrapped by setting the hydrophobic group of the modified polyamine/amide resin outside and, further, the cationic part of the modified polyamine/amide resin is reacted with a carboxyl group of the carboxy-modified polyvinyl alcohol by a kind of a crosslinking reaction.

As mentioned above, by providing a higher water-resistance effect to a reacted part of the resin with a crosslinking agent that is used in a protecting layer, it becomes possible to protect the elution of a binder or other components contained in a coated layer by water or humidity, and can improve the water-resistance (resistance against blocking, resistance against wet rubbing).

Further, since the protecting layer of the present invention has a three-dimensional structure by a crosslinking reaction of a carboxy-modified polyvinylalcohol with an epichlorohydrin resin, and a modified polyamino/amide resin, which has a cationic property and displays a dispersion effect to an anionic pigment, it is considered that the protecting layer of the present invention forms a more porous layer as compared with the conventional art. Therefore, since a fused product of a low heat-resistance material contained in a coated layer formed by a high temperature condition is absorbed by openings in the protecting layer, the thermally-sensitive recording medium of the present invention has an excellent printing runability (head debris resistance, sticking resistance).

In the present application, as a resin containing a carboxyl group, which is used as a binder in a protecting layer, any compound that has a carboxyl group can be used, for example, a resin that contains a mono-functional acrylic monomer possessing a carboxylic group, such as methacrylic acid, 2-hydroxyethyl-methacrylate, 2-hydroxypropyl-methacrylate, dimethylaminoethyl-methacrylate, tert-butylaminoethylmethacrylate, glycidylmethacrylate or tetrahydrofurfurylmethacrylate, starch oxide, carboxymethyl cellulose, carboxy-modified polyvinylalcohol prepared by introducing a carboxyl group into a polyvinyl alcohol can be mentioned. In particular, it is desirable to use a carboxy-modified polyvinylalcohol which is excellent in heat resistance and solvent resistance.

The carboxy-modified polyvinylalcohol used in the present invention is prepared by introducing a carboxyl group into a water-soluble polymer for the purpose of enhancing the reactivity of the water-soluble polymer, and can be obtained as a reacted product of polyvinylalcohol with a polyvalent carboxylic acid such as fumaric acid, phthalic anhydride, mellitic anhydride or itaconic anhydride, an esterficated product of these compounds, further, as a saponificated product of a copolymer composed of vinyl acetate with an ethylene-unsaturated dicarboxylic acid such as maleic acid, fumaric acid, itaconic acid, crotonic acid, acrylic acid or methacrylic acid. Specifically, for example, a method for preparation disclosed in JP S53-91995 A publication can be mentioned.

Further, the carboxy-modified polyvinylalcohol used in the present invention is characterized in that the Hercules viscosity of it is low. That is, at the state that the rotating power (share) is loaded, the fluidity of it becomes high, and when its share is low, it becomes easy to be immovable. Therefore, in the coating process, a coating liquid spreads smoothly and after being coated, it solidifies in a moment and forms a uniform and even coating layer. Accordingly, the quality of the printed image and sensitivity is improved. Furthermore, the carboxy-modified polyvinylalcohol is also characterized in that the water retention is high, it is possible to prevent permeation of a binder to a substrate, and by this effect too, an even coating layer can be formed, accordingly, the quality of a printed image and sensitivity is improved.

From the view point that the water-retention of a coating liquid is high and surface strength of a coating layer is good, the polymerization degree of the carboxy-modified polyvinylalcohol used in the present invention is desirably 1500 or more and the saponification degree of it is desirably 85% or more.

Further, as a crosslinking agent to be used in the present invention, an epichlorohydrin resin and modified polyamino/amide resin are used together. When these resins are used alone, a sufficient water-resistance cannot be obtained, and a problem such as blocking is caused. Still further, by another conventional crosslinking agent, such as the use together of glyoxal and an epichlorohydrin resin or modified polyamino/amide resin, sufficient water-resistance cannot be obtained.

As a specific example of an epichlorohydrin resin to be used in the present invention, a polyamide-epichlorohydrin resin or polyamine-epichlorohydrin resin can be mentioned, and these resins can be used alone or can be used together. As an amine which exists in the main chain, all amines from a primary amine to a quaternary amine can be used and it is not restricted. Further, the cationated degree and molecular weight, from the view point of good water-resistance, a cationated degree of 5 meq/g·Solid or less (measured at pH7) and a molecular weight of 500,000 or less are desirable. As a specific example, Sumirez Resin 675A (product of Sumitomo Chemical), Sumirez Resin 6615 (product of Sumitomo Chemical), WS4002 (product of Seiko PMC), WS4024 (product of Seiko PMC), WS4046 (product of Seiko PMC), WS4010 (product of Seiko PMC) or CP8970 (product of Seiko PMC) can be mentioned.

In the present invention, use together of an epichlorohydrin resin and a modified polyamino/amide resin is necessary. In general, this modified polyamino/amide resin is a printing aptitude-improving agent. For example, polyamide urea resin, polyethylene imine resin, polyalkylene polyamine resin and polyalkylene polyamide resin can be mentioned, and as a specific example, Sumirez Resin 302 (product of Sumitomo Chemical), Sumirez Resin 712 (product of Sumitomo Chemical), Sumirez Resin 703 (product of Sumitomo Chemical), Sumirez Resin 636 (product of Sumitomo Chemical), Sumirez Resin SPI-100 (product of Sumitomo Chemical), Sumirez Resin SPI-102A (product of Sumitomo Chemical), Sumirez Resin SPI-106N (product of Sumitomo Chemical), Sumirez Resin SPI-203(50) (product of Sumitomo Chemical), Sumirez Resin SPI-198 (product of Sumitomo Chemical), Printive A-700 (product of Asahi Kasei), Printive A-600 (product of Asahi Kasei), PA6500 (product of Seiko PMC), PA6504 (product of Seiko PMC), PA6634 (product of Seiko PMC), PA6638 (product of Seiko PMC), PA6640 (product of Seiko PMC), PA6644 (product of Seiko PMC), PA6646 (product of Seiko PMC), PA6654 (product of Seiko PMC), PA6702 (product of Seiko PMC), PA6704 (product of Seiko PMC) or CP8994 (product of Seiko PMC)

can be mentioned and is not restricted, however, from the view point of color-developing sensitivity, it is desirable to use a polyamine resin.

The desirable containing ratio of epichlorohydrin resin and modified polyamino/amide resin to be used in the present invention is as follows, that is, respectively 1-100 weight parts to 100 weight parts of carboxy-modified polyvinylalcohol and, more desirably, the containing ratio is 5-50 weight parts to 100 weight parts of carboxy-modified polyvinylalcohol. When the containing amount is too small, the crosslinking reaction is not sufficient and a good water-resistance cannot be obtained and when the containing amount is too much, the workability becomes worse because the viscosity of a coating liquid increases and causes a problem of gelation.

Further, the pH of a coating liquid for the protecting layer is desirably 6.0 or more. In particular, since an epichlorohydrin resin is an alkaline hardening type resin, an adequate crosslinking reaction is carried out at this range. If the pH is adjusted to a lower range than this range, the crosslinking reaction is disturbed.

For the purpose of improving a property of sticking resistance and ordinary printing aptitude, such as offset printing, it is desirable to add a pigment in a protecting layer of the thermally-sensitive recording medium of the present invention. As a pigment to be contained in the protecting layer, an inorganic or organic filler such as silica, calcium carbonate, kaolin, calcined kaolin, diatomaceous earth, talc, titanium oxide or aluminum hydroxide can be mentioned and is not restricted thereto, however, aluminum hydroxide, kaolin or silica is preferably used. Especially, it is desirable to use kaolin whose aspect ratio is 20 or more, more desirably 30 or more. By using a pigment whose aspect ratio is 20 or more, the coating ability of the thermally-sensitive recording medium is improved. Therefore, since the preserving sensitivity of an image part and blank part are improved and can prevent the deterioration of the thermal conduction rate to a thermally-sensitive recording layer by a smaller coating amount, excellent color-developing sensitivity and recorded image can be obtained. Further, by containing a pigment whose aspect ratio is 20 or more, the smoothness and luster of a surface of a coated layer can be improved. Therefore, the desired smoothness can be obtained by treatment with a low pressure super calendar, consequently, an excellent color-developing sensitivity and recorded image can be obtained. However, when the aspect ratio is over 100, since a protecting layer becomes dense, problems of ink-fixing ability, ink-drying ability and color-developing sensitivity at an ordinary printing process are caused. Accordingly, a more desirable aspect ratio of kaolin to be contained in a thermally sensitive recording layer is 20-100 and furthermore desirably is 30-75. Further, when the average diameter of a pigment whose aspect ratio is 30 or more, which is contained in a protecting layer, is longer than 4 μm, the pigment is exposed on the surface of a coated layer, accordingly, problems, such as deterioration of surface smoothness, deterioration of the quality of a recorded image, deterioration of luster, deterioration of luster of printed part and increase in friction with a thermal head (head abrasion) are caused. Therefore, the average diameter of a pigment whose aspect ratio is 30 or more to be contained in a protecting layer is desirably shorter than 4 μm. Furthermore, when the oil-absorbing amount of a pigment whose aspect ratio is 30 or more is 30-100 ml/100 g, the ink-fixing ability and printed part luster of an ordinary printing method becomes better. When the oil-absorbing amount is smaller than 30 ml/100 g, the ink-fixing ability becomes a problem because an ink for ordinary printing is not easily absorbed, and when the oil-absorbing amount is larger than 100 ml/100 g, since an ink for ordinary printing is excessively absorbed, a thermally sensitive recording medium having an excellent printed part luster cannot be obtained. While, in the present invention, the term "aspect ratio of a pigment" means the numerical value calculated as follows. That is, the powder is photographed by an electric microscope and 100 specimens of particles are picked up at random, and "diameter/thickness" of each 100 particles are calculated and averaged, therefore, a larger aspect ratio means that the pigment has a greater flatness.

A desirable containing ratio of the carboxy-modified polyvinylalcohol to be used in the present invention is 10-500 weight parts to 100 weight parts of pigment and, more desirably, 20-250 weight parts to 100 weight parts of pigment. When the containing ratio is too small, the problem of deterioration of printing aptitude by the lowering of surface strength, while, when the containing ratio is too large, the viscosity of the coating liquid becomes high and coating at a high concentration becomes difficult. Further, when the concentration of a coating liquid is lowered, it is necessary to coat an excess amount of coating to obtain the same coating amount and is not desirable because load to drying process is increased.

Further, when containing kaolin with an aspect ratio of 30 or more, it is desirably used alone for the purpose of displaying an excellent effect based on its specific shape, however, it can be used together with various other pigments when the containing ratio of an inorganic pigment having an aspect ratio of 30 or more is 50 weight parts or more, desirably 80 weight parts or more, to 100 parts of the total blending amount of pigment.

The containing of a carboxyl group-containing resin in a thermally-sensitive recording layer of the present invention is desirable because the adhering ability between a protecting layer and a thermally-sensitive recording layer is improved and the water-resistance at a boundary part becomes better. The reason why can be explained as follows, that is, a carboxyl group-containing resin contained in a thermally-sensitive recording layer causes a crosslinking reaction with an epichlorohydrin resin and modified polyamino/amide resin contained in a protecting layer, accordingly, the water-resistance at a boundary part between a protecting layer and a thermally-sensitive recording layer is improved, further, self-adhering is caused. In particular, in a case, when a carboxy-modified polyvinylalcohol, which is a hydrophilic compound, is used in a protecting layer and a thermally-sensitive recording layer, remarkable effect can be recognized. It is desirable that the carboxy-containing resin is contained in an amount of 30 weight % or more to the total amount of binder contained in a thermally-sensitive recording layer.

Furthermore, it is desirable to contain an epichlorohydrin resin in a thermally-sensitive recording layer of the thermally-sensitive recording medium of the present invention. By containing the same epichlorohydrin resin that is contained in the protecting layer, the adhesive property between the thermally-sensitive recording layer and the protecting layer is improved and the dipping water-resistance is improved. Moreover, it is desirable to add 0.2-2.0 weight parts of an epichlorohydrin resin to a thermally-sensitive recording layer. When the adding amount of the epichlorohydrin resin is too much, the stability of a coating deteriorates.

Secondly, specific examples of various materials which are used in the present invention are shown as follows, however, a binder, a crosslinking agent and a pigment can be used not only in a protecting layer but also in any coating layers formed by occasional demands in a range not disturbing the desired effect of the above-mentioned object.

As a binder used in the present invention, for example, a fully-saponified polyvinyl alcohol having a degree of polymerization of 200 to 1,900, partially-saponified polyvinyl alcohol, acetoacetyl polyvinyl alcohol, carboxy-modified polyvinyl alcohol, amide-modified polyvinyl alcohol, sulfonic acid-modified polyvinyl alcohol, butyral-modified polyvinyl alcohol, olefin-modified polyvinyl alcohol, nitlile-modified polyvinyl alcohol, pyrrolidone-modified polyvinyl alcohol, silicone-modified polyvinyl alcohol, other modified polyvinyl alcohols, hydroxyethylcellulose, methylcellulose, ethylcellulose, carboxymethylcellulose, styrene-maleic anhydride copolymer, styrene-butadiene copolymer, a cellulose derivative such as ethylcellulose or acetylcellulose, casein, gum arabic, starch oxide, eterficated starch, dialdehyde starch, esterficated starch, polyvinyl chloride, polyvinyl acetate, polyacrylamide, polyacrylate, polyvinyl butyral, polystyrol and a copolymer thereof, polyamide resin, silicon resin, petroleum resin, terpene resin, ketone resin and cumarone resin can be mentioned. Those high molecular weight substances can be used by dissolving them in a solvent such as water, an alcohol, ketones, esters or a hydrocarbon, or emulsifying or dispersing as a paste in water or another medium, and can be used according to the desired quality.

As a crosslinking agent used in the present invention, for example, glyoxal, methylolmelamine, melamine formaldehyde resin, melamine urea resin, polyamine epichlorohydrin resin, polyamide epichlorohydrin resin, potassium peroxide, ammonium peroxide, sodium peroxide, iron (III) oxide, magnesium chloride, borax, boric acid, alum or ammonium chloride can be mentioned.

As a pigment used in the present invention, for example, inorganic or inorganic fillers such as silica, calcium carbonate, kaolin, calcined kaoline, diatomaceous earth, talc, titanium oxide or aluminum hydroxide can be mentioned. As a pigment to be used in a protecting layer, aluminum hydroxide or kaolin are desirable from the view point of abrasion of a thermal head.

As a slipping agent used in the present invention, for example, a metallic salt of a fatty acid such as zinc stearate or calcium stearate, waxes or silicone resin can be mentioned.

In the present invention, an image stabilizer which displays an oil-resistance effect can be added in the range that does not alter the desired effect to the above-mentioned object, for example, 4,4'-butylidene (6-t-butyl-3-methylphenol), 2,2'-di-t-butyl-5,5'-dimethyl-4,4'-sulphonyldiphenol, 1,1,3-tris(2-methyl-4-hydroxy-5-cyclohexylphenyl)butane, 1,1,3-tris(2-methyl-4-hydroxy-5-t-butylphenyl)butane, 4-benzyloxy-4'-(2,3-epoxy-2-methylpropoxy)diphenyl-sulfone or others can be mentioned.

Still further, a benzophenone or triazole ultraviolet ray-absorbing agent, a dispersing agent, a defoaming agent, antioxidant or a fluorescent dye or others can be used.

As an electron-donating leuco dye used in the present invention, all compounds which are publicly known in the field of conventional pressure-sensitive or thermally-sensitive recording paper can be used and not restricted, however, triphenylmethane compounds, fluorane compounds, fluorene compounds or divinyl compounds are desirably used.

Specific example of leuco or pale-colored dyes (dye precursor) are shown as follows. These compounds can be used alone or can be used together.

<Triphenyl Methane Leuco Dye>

3,3'-bis(p-dimethylaminophenyl)-6-dimethylaminophthalide (Crystal Violet Lactone), 3,3-bis(p-dimethylaminophenyl)phthalide (Malachite Green Lactone)

<Fluorane Leuco Dyes>

3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylaminofluorane
3-diethylamino-6-methyl-7-dibenzylamonofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[a]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane 3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)aminoanilino-fluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)aminoanilino-fluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane
3-diethylamino-6-p-(p-dibutylaminophenyl)aminoanilinofluorane
2,4-dimethyl-6-[(4-dimethylamino)anilino]-fluorane <Fluorene Leuco Dyes>
3,6,6'-tris(dimethylamino)spiro[fluorene-9,3'-phthalide]
3,6,6'-tris(diethylamino)spiro[fluorene-9,3'-phthalide]

<Divinyl Leuco Dyes>
3,3-bis-[2-(p-dimethylaminophenyl)-2-(p-methoxy-phenyl) ethenyl]-4,5,6,7-tetrabromo phthalide
3,3-bis-[2-(p-dimethylaminophenyl)-2-(p-methoxy-phenyl) ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>
3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluorane-y-(3'-nitro)anilinolactam
3,6-bis(diethylamino)fluorane-y-(4'-nitro)anilinolactam
1,1-bis-[2',2',2", 2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphtho yl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonic acid dimethyl ester.

As an electron-accepting color-developing agent used in the present invention, all publicly known color-developing agents in conventional pressure-sensitive or thermally-sensitive recording paper fields can be used and is not especially restricted, however, for example, an inorganic acidic compound such as activated clay, attapulgite, colloidal silica or aluminum silicate, 4,4'-isopropylidenediphenol, 1,1-bis(4-hydroxy-phenyl)cyclohexane, 2,2-bis(4-hydroxyphenyl)-4-methylpentane, 4,4'-dihydroxydiphenylsulfide, hydroquinonemonobenzylether, 4-hydroxybenzylbenzoate, 4,4'-dihydroxydiphenylsulfone, 2,4'-dihydroxydiphenylsulfone, 4-hydroxy-4'-isopropoxydiphenylsulfone, 4-hydroxy-4'-n-propoxydiphenylsulfone, bis(3-allyl-4-hydroxyphenyl)sulfone, 4-hydroxy-4'-methyldiphenylsulfone, 4-hydroxyphenyl-4'-benzyloxyphenylsulfone, 3,4-dihydroxy-phenyl-4'-methylphenylsulfone, aminobenzenesulfoamide derivatives disclosed in JPH8-59603A publication, bis(4-hydroxyphenylthioethoxy)methane, 1,5-di(4-hydroxyphenylthio)-3-oxapentane, bis(p-hydroxy-phenyl)butylacetate, bis(p-hydroxyphenyl)methylacetate, 1,1-bis(4-hydroxyphenyl)-1-phenylethane, 1,4-bis[α-methyl-α-(4'-hydroxyphenyl)ethyl] benzene, 1,3-bis[α-methyl-α-(4'-hydroxyphenyl)ethyl] benzene, di(4-hydroxy-3-methylphenyl)sulfide, 2,2'-thiobis (3-tert-octylphenol), 2,2'-thiobis(4-tert-octylphenol), a phenolic compound such as a diphenylsulfone crosslinked compound disclosed in WO97/16420 International Publication, a compound disclosed in WO02/081229 International Publication or JP2002-301873 A publication, a thiourea compound such as N,N'-di-m-chlorophenylthiourea, thiourea compounds such as p-chlorobenzoic acid, stearyl gallate, bis [4-(n-octyloxy-cabonylamino)zincsalicylate]di-hydrate, an aromatic carboxylic acid such as 4-[2-(p-methoxyphenoxy) ethyloxy]salicylic acid, 4-[3-(p-tolylsulfonyl)propyloxy] salicylic acid or 5-[p-(2-p-p-methoxyphenoxyethoxycumyl) salicylic acid, and salts of these aromatic acids with a polyvalent metal such as zinc, magnesium, aluminium, calcium, titanium, manganese, tin or nickel, an antipyrine complex of zinc thiocyanate, and a complex zinc salt of terephthalaldehydric and other aromatic carboxylic acids can be mentioned. These color-developing agents can be used alone or together. A diphenylsulfone crosslinking compound disclosed in WO97/16420 International Publication can be purchased as D-90, which is a product of Nihon Soda. Further, the compound disclosed in WO02/081229 International Publication can be purchased as commodity name NKK-395, D-100 of Nihon Soda. Still further, it is possible to contain a metal chelate color-developing component such as the higher fatty acid metal complex salt disclosed in JP H10-258577 A publication or divalent hydroxyl aromatic compounds.

As a sensitizer used in a thermally-sensitive recording medium of the present invention, conventional publicly known sensitizers can be used. As a specific example of the sensitizer, a fatty acid amide such as an amide stearate, or amide parmitate, ethylenebisamide, montan wax, polyethylene wax, 1,2-di(3-methylphenoxy)ethane, p-benzylbiphenyl, β-benzyloxy naphthalene, 4-biphenyl-p-tolylether, m-terphenyl, 1,2-diphenoxyethane, dibenzyloxalate, di(p-chlorobenzyl)oxalate, di(p-methylbenzyl)oxalate, dibenzylterephthalate, benzyl-p-benzyloxybenzoate, di-p-tolylcarbonate, phenyl-α-naphythylcarbonate, 1,4-diethoxynaphthalene, phenyl-1-hydroxy-2-naphthoate, o-xylene-bis-(phenylether), 4-(m-methylphenoxymethyl)biphenyl, dibenzyl-4,4'-ethylenedioxy-bis-benzoate, dibenzoyloxymethane, 1,2-di(3-methylphenoxy)ethylene, bis[2-(4-methoxy-phenoxy)ethyl]ether, methyl-p-nitrobenzoate or phenyl-p-toluenesulfonate can be mentioned, however, it is not restricted to these compounds. These sensitizers can be used alone or can be used together.

The kinds and amount of electron-donating leuco dye, electron-accepting color-developing agent and other components which are used in the thermally-sensitive recording medium of the present invention, are decided according to the required properties and recording aptitude and not restricted, however, in general, 0.5 to 10 parts of an electron-accepting color-developing agent, 0.5 to 10 parts of sensitizer to 1 part of electron-donating leuco dye are used.

The desired thermally-sensitive recording medium can be obtained by coating a coating liquid composed of the above-mentioned constitution on a substrate such as paper, recycled paper, film, plastic film, foamed plastic film or non-woven cloth. A complex sheet prepared by combining these substrates can be used as a substrate.

An electron-donating leuco dye, electron-accepting color-developing agent and materials to be added by occasional demands are ground by a grinding machine such as ball mill, attritor or sand grinder or adequate emulsifying machine so that the particle size becomes several microns or less, further, a binder and various additives are added according to the object, thus a coating liquid is prepared. The method for coating is not restricted and conventional well-known techniques can be used, for example, an off machine coater with various coaters such as an air knife coater, rod blade coater, vent blade coater, bevel blade coater, roll coater or curtain coater or an on machine coater can be voluntarily chosen and used. The coating amount of a thermally-sensitive recording layer is not restricted and, in general, is in the range of 2-12 $g/m^2$ by dry weight. Further, the coating amount of a protecting layer provided on a thermally-sensitive recording layer is not restricted and, in general, is in the range of 1-5 $g/m^2$ by dry weight.

The thermally sensitive recording medium of the present invention can provide an undercoating layer composed of a polymer-containing filler under a thermally-sensitive recording layer for the purpose of enhancing the color-developing sensitivity. Further, the thermally-sensitive recording medium can provide a back coating layer on the opposite side of the substrate to which the thermally-sensitive recording layer is provided, for the purpose of correcting the curling of the sheet. Furthermore, various publicly known techniques in the field of the thermally-sensitive recording medium can be added voluntarily, for example, carrying out a smoothness treatment such as a super calendar treatment after the coating of each layer.

EXAMPLE

The thermally-sensitive recording medium of the present invention will be illustrated by the Examples. In the illustration, parts and % indicate weight parts and weight %. Each of the solutions, dispersions and coating liquids are prepared as follows.

Example 1

Compounds of the following ratios were stirred and dispersed and a coating liquid for an undercoating layer was prepared.

| U solution (coating liquid for undercoating layer) | |
|---|---|
| Calcined kaolin(product of Engelhard, commodity name: Ansilex 90) | 100 parts |
| styrene•butadiene copolymer latex (solid part 48%) | 40 parts |
| 10% aqueous solution of fully saponificated polyvinyl-alcohol (product of Kuraray, commodity name: PVA117) | 30 parts |
| water | 160 parts |

After applying the coating liquid for the undercoating layer on one surface of a substrate (paper of 60 $g/m^2$) and drying, a coating paper with an undercoating layer of a dry coating amount of 10.0 $g/m^2$ was obtained.

A dispersion of color-developing agent (A solution), dispersion of leuco dye (B solution) and dispersion of sensitizer (C solution) of the following compositions were ground separately by a sand grinder in a wet condition so that the average particle size was 0.5 micron.

| A solution (dispersion of color developing agent) | |
|---|---|
| 4-hydroxy-4'-isopropoxydiphenylsulfone | 6.0 parts |
| 10% aqueous solution of polyvinyl alcohol | 18.8 parts |
| water | 11.2 parts |
| **B solution (dispersion of basic leuco dye)** | |
| 3-dibutylamino-6-methyl-7-anilinofluorane (ODB-2) | 3.0 parts |
| 10% aqueous solution of polyvinyl alcohol | 6.9 parts |
| Water | 3.9 parts |
| **C solution (dispersion of sensitizer)** | |
| dibenzyl oxalate | 6.0 parts |
| 10% aqueous solution of polyvinyl alcohol | 18.8 parts |
| water | 11.2 parts |

Then dispersions were mixed by the following ratios and a coating liquid for a thermally-sensitive layer was obtained. Coating liquid for a thermally-sensitive layer

| | |
|---|---|
| A solution (dispersion of color-developing agent) | 36.0 parts |
| B solution (leuco dye dispersion) | 13.8 parts |
| C solution (dispersion of sensitizer) | 36.0 parts |
| 10% aqueous solution of full saponificated polyvinylalcohol (product of Kuraray, commodity name: PVA117) | 25 parts |

After applying the coating liquid for the thermally-sensitive recording layer on an undercoating layer of the undercoated paper and drying, a coated paper with a thermally-sensitive layer of a coating amount of 6.0 g/m$^2$ is obtained.

Then, a coating liquid for a protecting layer is obtained by mixing in the following ratio.

| | |
|---|---|
| 50% dispersion of aluminum hydroxide (product of Martinsberg, aspect ratio: 5, average particle size; 3.5 μm, oil absorbing amount: 50 ml/100 g) | 9.0 parts |
| 10% aqueous solution of carboxy-modified polyvinylalcohol (product of Kuraray, commodity name: KL118 <polymerization degree: around 1700, saponification degree: 95-99 mol %, sodium acetate: 3% or less>) | 30 parts |
| zinc stearate (product of Chukyo Yushi, commodity name: Hydrine Z-7-30, solid part 30%) | 2.0 parts |
| polyamide epichlorohydrine resin (product of SEIKO PMC: commodity name: WS4020, solids part 25% <cationic degree: 2.7, molecular weight 2,200,000, quaternary amine>) | 4.0 parts |
| modified polyamine resin (product of Sumitomo Chemical: Sumirez Resin SPI-102A, solid part 45%) | 2.2 parts |

Then, the coating liquid for a protecting layer is coated on a thermally-sensitive recording layer of the above-mentioned paper for a thermally-sensitive recording layer coating so that the coating amount is 3.0/m$^2$, dried and treated by a super calendar so that the smoothness is 1000-2000 seconds, and a thermally-sensitive recording medium is obtained.

Example 2

A thermally-sensitive recording medium is prepared by the same method as Example 1 except for changing the carboxy-modified polyvinylalcohol to be blended in a coating liquid for a protecting layer of Example 1 to another carboxy-modified polyvinylalcohol (product of Kuraray, commodity name: KL318<polymerization degree: around 1,700, saponification degree: 85-90 mol %, sodium acetate: 3% or less>)

Example 3

A thermally-sensitive recording medium is prepared by the same method as Example 1 except for changing the carboxy-modified polyvinylalcohol to be blended in a coating liquid for a protecting layer of Example 1 to another carboxy-modified polyvinylalcohol (product of Nihon Gose Kagaku, commodity name: T350<polymerization degree: around 1,700, saponification degree: 93-95 mol %, sodium acetate: 3% or less>).

Example 4

A thermally-sensitive recording medium is prepared by the same method as Example 1 except for changing 4.0 parts of a polyamide-epichlorohydrine resin to be blended in a coating liquid for a protecting layer of Example 1 to 5.0 parts of another polyamide-epichlorohydrine resin (product of SEIKO PMC: commodity name: WS4010, solids part 20%<cationic degree: 3.9, molecular weight 800,000, quaternary amine>).

Example 5

A thermally-sensitive recording medium is prepared by the same method as Example 1 except for changing 4.0 parts of the polyamide-epichlorohydrine resin to be blended in a coating liquid for a protecting layer of Example 1 to 2.0 parts of another polyamide-epichlorohydrine resin (product of SEIKO PMC: commodity name: SRD150, solids part 50%<cationic degree: 6.7, molecular weight 400,000, quaternary amine>).

Example 6

A thermally-sensitive recording medium is prepared by the same method as Example 1 except for changing 2.2 parts of the modified polyamine resin to be blended in a coating liquid for a protecting layer of Example 1 to 1.7 parts of another modified polyamine resin (product of Sumitomo Kagaku: commodity name: Sumirez Resin SPI-106N, solid part 60%).

Example 7

A thermally-sensitive recording medium is prepared by the same method as Example 1 except for changing 2.2 parts of the modified polyamine resin to be blended in a coating liquid for a protecting layer of Example 1 to 1.7 parts of another modified polyamine resin (product of SEIKO PMC: commodity name: PA6640, solids part 60%).

Example 8

A thermally-sensitive recording medium is prepared by the same method as Example 1 except for changing the fully saponificated polyvinylalcohol of a coating liquid for a thermally-sensitive recording layer to a 10% aqueous solution of a carboxy-modified polyvinylalcohol (product of Kuraray, commodity name: KL118<polymerization degree: around 1,700, saponification degree: 95-99 mol %, sodium acetate: 3% or less>).

Example 9

A thermally-sensitive recording medium is prepared by the same method as Example 1 except for changing 9.0 parts of 50% dispersion of aluminum hydroxide to be blended in a coating liquid for a protecting layer of Example 1 to 9.1 parts of a 50% dispersion of kaolin (commodity name: Capim NP, product of RIO CAPIM, aspect ratio: 20, average particle size: 2.2 μm, oil-absorption amount: 45 ml/100 g).

Example 10

A thermally-sensitive recording medium is prepared by the same method as Example 1 except for changing 9.0 parts of a 50% dispersion of aluminum hydroxide to be blended in a coating liquid for a protecting layer of Example 1 to 1.0 parts of a 50% dispersion of kaolin (commodity name: Contour 1500, product of IMERYS, aspect ratio: 60, average particle size: 2.5 μm, oil-absorption amount: 45 ml/100 g:).

Example 11

A thermally-sensitive recording medium is prepared by the same method as Example 10 except for changing the fully saponificated polyvinylalcohol of a coating liquid for a thermally-sensitive recording layer to a 10% aqueous solution of a carboxy-modified polyvinylalcohol (product of Kuraray, commodity name: KL118<polymerization degree: around 1,700, saponification degree: 95-99 mol %, sodium acetate: 3% or less>) and adding 0.8 parts of polyamide-epichlorohydrine resin (product of SEIKO PMC: commodity name: WS4020).

Example 12

A thermally-sensitive recording medium is prepared by the same method as Example 1 except for changing 2.2 parts of modified polyamine resin to be blended in a coating liquid for a protecting layer of Example 1 to 2.2 parts of a modified imine resin (product of SEIKO PMC: commodity name: CPA8994, solids part 40%).

Example 13

A thermally-sensitive recording medium is prepared by the same method as Example 10 except for changing the fully saponificated polyvinylalcohol of a coating liquid for a thermally-sensitive recording layer to a 10% aqueous solution of a carboxy-modified polyvinylalcohol (product of Kuraray, commodity name: KL118<polymerization degree: around 1,700, saponification degree: 95-99 mol %, sodium acetate: 3% or less>).

Comparative Example 1

A thermally-sensitive recording medium is prepared by the same method as Example 1 except changing the modified polyamine resin to be blended in a coating liquid for a protecting layer of Example 1 to fully saponified polyvinylalcohol (product of Kuraray, commodity name: PVA117<polymerization degree: around 1,700, saponification degree: 98-99 mol %, sodium acetate: 1% or less>).

Comparative Example 2

A thermally-sensitive recording medium is prepared by the same method as Example 1 except for changing the modified polyamine resin to be blended in a coating liquid for a protecting layer of Example 1 to a partially saponified polyvinylalcohol (product of Kuraray, commodity name: PVA217 <polymerization degree: around 1700, saponification degree: 87-89 mol %, sodium acetate: 1% or less>).

Comparative Example 3

A thermally-sensitive recording medium is prepared by the same method as Example 1 except for not blending a polyamide-epichlorohydrin resin to be blended in a coating liquid for a protecting layer of Example 1, and changing 2.2 parts of the modified polyamine resin to 4.4 parts.

Comparative Example 4

A thermally-sensitive recording medium is prepared by the same method as Example 1 except for not blending the modified polyamine resin to be blended in a coating liquid for a protecting layer of Example 1, and changing 4.0 parts of the polyamide-epichlorohydrin resin to 8.0 parts.

Comparative Example 5

A thermally-sensitive recording medium is prepared by the same method as Example 1 except for not blending the polyamide-epichlorohydrin resin and the modified polyamine resin to be blended in a coating liquid for a protecting layer of Example 1, and blending 5.0 parts of a 40% aqueous solution of glyoxal instead of the polyamide-epichlorohydrin resin and modified polyamine resin.

Comparative Example 6

A thermally-sensitive recording medium is prepared by the same method as Example 1 except for not blending the polyamide-epichlorohydrin resin to be blended in a coating liquid for a protecting layer of Example 1, and blending 2.5 parts of a 40% aqueous solution of glyoxal instead of the polyamide-epichlorohydrin resin.

Comparative Example 7

A thermally-sensitive recording medium is prepared by the same method as Example 1 except for not blending the modified polyamine resin to be blended in a coating liquid for a protecting layer of Example 1, and blending 2.5 parts of a 40% aqueous solution of glyoxal instead of the modified polyamine resin.

<Evaluation of Recording Sensitivity>

A printing test was carried out on the prepared thermally-sensitive recording medium at an applied energy of 0.41 mJ/dot by using TH-PMD of Okura Denki, (printing tester for thermally-sensitive recording paper, thermal head of Kyocera is attached). The density of the printed image was measured by a Macbeth Densitometer (RD-914, using an amber filter).

<Evaluation of Water Resistance>

(1) Blocking Test

10 μl of water was dropped on the recorded surface of a thermally-sensitive recording medium after an evaluation test of the recording sensitivity, and is folded to two so that the recorded surface is inside, 100 g/cm$^2$ weight was loaded on the recording medium and left for 24 hours under an environment of 40° C., 90% Rh. After that the recorded surface was opened and a blocking test was carried out. The evaluation standard was indicated as follows.

- O: blocking was not observed, and removal of recorded layer was not observed
- x: blocking was caused, recorded layer was partially removed and discrimination of the recorded part was difficult (2) Wet Rubbing Test 50 μl of water was dropped on the recorded surface of a thermally-sensitive recording medium after an evaluation test of the recording sensitivity, and the surface of the recorded surface was rubbed strongly by a finger. The degree of water-resistance was evaluated. The evaluation standard was indicated as follows.

- O: no slimy feeling, and removal of recorded layer was not observed
- Δ: slightly slimy touch but removal of the recorded layer was not observed
- x: recorded layer was eluted, recorded layer was partially removed and discrimination of recorded part is difficult (3) Dipping Water Resistance Test A thermally-sensitive recording medium on which a pattern (No. 8 check) was printed using TH-PMD of Okura Denki (printing tester for a thermally-sensitive recording paper, a thermal head of Kyocera was attached) was dipped in tap water (23° C.) for 48 hours and evaluated by the following standard.

O: remaining density of the recorded part was over 90%, a water bubble was slightly observed between the protecting layer and the thermally-sensitive recording layer but removal of the protecting layer was not observed Δ: the remaining density of the recorded part was over 90%, a water bubble was observed between the protecting layer and thermally-sensitive recording layer and protecting was partially removed X: the remaining density of the recorded part was less than 90% and the protecting layer was almost removed <Evaluation of Printing Run-Ability>

(1) Head Debris Test

A printing test was carried out on the prepared thermally-sensitive recording medium at an applied energy of 0.41 mJ/dot by using TH-PMD of Okura Denki, (printing tester for a thermally-sensitive recording paper, a thermal head of Kyocera is attached). Head debris adhering was evaluated by the following standard.

O: head debris was not observed

Δ: head debris was observed slightly

X: many head debris were clearly observed (2) Sticking Test

A printing test was carried out on the prepared thermally-sensitive recording medium at an applied energy of 0.41 mJ/dot at −10° C. temperature by using TH-PMD of Okura Denki, (printing tester for a thermally sensitive recording paper, thermal head of Kyocera is attached). Sticking and noise during the recording process were evaluated by the following standard.

O: sticking was not observed and no noise

Δ: sticking was observed slightly and no noise

X: sticking was observed frequently and the amount of noise was large

The peculiar points of a protecting layer and thermally-sensitive recording layer of each of the Examples and Comparative Examples are listed in Table 1 and the evaluation results by the above-mentioned evaluation items are summarized in Table 2.

In the Tables, PVA means carboxy-modified PVA and aluminum means aluminum hydroxide.

TABLE 1

| | | protecting layer | | | | | | |
|---|---|---|---|---|---|---|---|---|
| | | | crosslinking agent (solid parts) | | | | | |
| | | | | modified polyamine/ | | | thermally sensitive recording layer | |
| | | binder | epichlorohydrine resin | amide resin | glyoxal | pigment/ aspect ratio | binder | Epichlorohydrine resin |
| Example | 1 | PVA | 1 | 1 | — | aluminum 5 | f.s.PVA | no |
| | 2 | PVA | 1 | 1 | — | aluminum 5 | f.s.PVA | no |
| | 3 | PVA | 1 | 1 | — | aluminum 5 | f.s.PVA | no |
| | 4 | PVA | 1 | 1 | — | aluminum 5 | f.s.PVA | no |
| | 5 | PVA | 1 | 1 | — | aluminum 5 | f.s.PVA | no |
| | 6 | PVA | 1 | 1 | — | aluminum 5 | f.s.PVA | no |
| | 7 | PVA | 1 | 1 | — | aluminum 5 | f.s.PVA | no |
| | 8 | PVA | 1 | 1 | — | aluminum 5 | PVA | no |
| | 9 | PVA | 1 | 1 | — | kaolin 20 | f.s.PVA | no |
| | 10 | PVA | 1 | 1 | — | kaolin 60 | f.s.PVA | no |
| | 11 | PVA | 1 | 1 | — | kaolin 60 | PVA | yes |
| | 12 | PVA | 1 | 1 | — | aluminum 5 | f.s.PVA | no |
| | 13 | PVA | 1 | 1 | — | kaolin 60 | PVA | no |
| Comparative Example | 1 | f.s.PVA | 1 | 1 | — | aluminum 5 | f.s.PVA | no |
| | 2 | f.s.PVA | 1 | 1 | — | aluminum 5 | f.s.PVA | no |
| | 3 | PVA | 0 | 2 | — | aluminum 5 | f.s.PVA | no |
| | 4 | PVA | 2 | 0 | — | aluminum 5 | f.s.PVA | no |
| | 5 | PVA | 0 | 0 | 2 | aluminum 5 | f.s.PVA | no |
| | 6 | PVA | 0 | 1 | 1 | aluminum 5 | f.s.PVA | no |
| | 7 | PVA | 1 | 0 | 1 | aluminum 5 | f.s.PVA | no |

PVA: carboxy modified polyinylalcohol
aluminum: aluminum hydroxide
f.s.PVA: full saponificated polyinylalcohol

TABLE 2

| | quality of thermally sensitive recording medium | | | | | |
|---|---|---|---|---|---|---|
| | color | water resistance | | | printing run-ability | |
| | developing sensitivity | blocking | wet rubbing | dip-ping | head debris | sticking |
| Exmp. 1 | 1.47 | ○ | ○ | Δ | ○ | ○ |
| Exmp. 2 | 1.45 | ○ | ○ | Δ | ○ | ○ |
| Exmp. 3 | 1.44 | ○ | ○ | Δ | ○ | ○ |
| Exmp. 4 | 1.46 | ○ | ○ | Δ | ○ | ○ |
| Exmp. 5 | 1.44 | ○ | Δ | Δ | ○ | Δ |
| Exmp. 6 | 1.45 | ○ | ○ | Δ | ○ | ○ |
| Exmp. 7 | 1.47 | ○ | ○ | Δ | ○ | ○ |
| Exmp. 8 | 1.45 | ○ | ○ | ○ | ○ | ○ |
| Exmp. 9 | 1.51 | ○ | ○ | Δ | ○ | ○ |
| Exmp. 10 | 1.60 | ○ | ○ | Δ | ○ | ○ |
| Exmp. 11 | 1.60 | ○ | ○ | ○ | ○ | ○ |
| Exmp. 12 | 1.39 | ○ | ○ | Δ | ○ | ○ |
| Exmp. 13 | 1.59 | ○ | ○ | ○ | ○ | ○ |
| Co. Ex. 1 | 1.39 | x | x | x | x | x |
| Co. Ex. 2 | 1.37 | x | x | x | x | x |
| Co. Ex. 3 | 1.43 | x | x | x | x | x |
| Co. Ex. 4 | 1.47 | x | Δ | x | Δ | Δ |
| Co. Ex. 5 | 1.45 | x | x | x | x | Δ |

TABLE 2-continued

| | quality of thermally sensitive recording medium | | | | | |
|---|---|---|---|---|---|---|
| | color | water resistance | | | printing run-ability | |
| | developing sensitivity | blocking | wet rubbing | dip-ping | head debris | sticking |
| Co. Ex. 6 | 1.42 | x | x | x | x | Δ |
| Co. Ex. 7 | 1.44 | x | Δ | x | Δ | Δ |

INDUSTRIAL APPLICABILITY

In the present invention, a thermally-sensitive recording medium having excellent water-resistance, printing run-ability (head debris, sticking) and sensitivity can be obtained by containing a carboxyl-group containing resin as a binder and by containing an epichlorohydrin resin together with a modified polyamine/amide resin as a crosslinking agent in a protecting layer. Especially, the thermally-sensitive recording medium has sufficient water-resistance to water such as rain or humidity, when used outside.

The invention claimed is:

1. A thermally-sensitive recording medium comprising a protecting layer provided on a thermally sensitive recording layer containing a colorless or pale-colored electron-donating leuco dye and an electron-accepting color-developing agent, said thermally-sensitive recording layer being formed on a substrate and said protecting layer comprising a resin that contains a carboxyl group, at least one epichlorohydrin resin and a modified polyamine/amide resin, wherein at least one of the epichlorohydrin resin is a polyamide-epichlorohydrin resin and the modified polyamine/amide resin is a modified polyamine resin.

2. The thermally-sensitive recording medium of claim 1, wherein the thermally-sensitive recording layer contains a resin that contains a carboxyl group.

3. The thermally-sensitive recording medium according to claim 2, wherein the resin that contains a carboxyl group in the thermally-sensitive recording layer is a carboxy-modified polyvinylalcohol.

4. The thermally-sensitive recording medium of claim 1, wherein the resin that contains a carboxyl group in the protecting layer is a carboxy-modified polyvinylalcohol.

5. The thermally-sensitive recording medium according to claim 1, wherein said protecting layer contains kaolin and/or aluminum hydroxide.

6. The thermally-sensitive recording medium of claim 5, wherein the aspect ratio of kaolin contained in the protecting layer is 20 or more.

7. The thermally-sensitive recording medium according to claim 1, wherein the epichlorohydrin resin contained in the protecting layer has a molecular weight of 500,000 or more and a cationic degree of 5 meq/100 g or less.

8. The thermally-sensitive recording medium according to claim 1, wherein the modified polyamine/amide resin is a polyalkylene polyamide resin and/or polyalkylene polyamine resin.

9. The thermally-sensitive recording medium according to claim 1, wherein said thermally-sensitive recording layer contains an epichlorohydrin resin.

* * * * *